United States Patent [19]

Sayles

[11] 3,986,906

[45] Oct. 19, 1976

[54] ULTRAHIGH BURNING RATE PROPELLANTS CONTAINING AN ORGANIC PERCHLORATE OXIDIZER

[75] Inventor: David C. Sayles, Huntsville, Ala.

[73] Assignee: The United States of America as represented by the Secretary of the Army, Washington, D.C.

[22] Filed: Dec. 23, 1974

[21] Appl. No.: 535,334

[52] U.S. Cl. ..... 149/19.4; 149/19.9; 149/20; 149/22; 149/75

[51] Int. Cl.[2] ..... C06B 45/10

[58] Field of Search ..... 149/19.2, 19.9, 22, 149/75, 19.4, 20

[56] References Cited

UNITED STATES PATENTS

| | | | |
|---|---|---|---|
| 3,666,575 | 5/1972 | Fisher | 149/19.9 X |
| 3,745,074 | 7/1973 | Allen | 149/19.9 X |
| 3,748,199 | 7/1973 | Uriesen et al. | 149/19.9 X |
| 3,770,526 | 11/1973 | Sayles | 149/22 |
| 3,816,380 | 6/1974 | Reed | 149/19.2 X |
| 3,860,463 | 1/1975 | Sayles | 149/19.9 |

*Primary Examiner*—Edward A. Miller

*Attorney, Agent, or Firm*—Nathan Edelberg; Robert P. Gibson; Jack W. Voigt

[57] ABSTRACT

A solid propellant composition that employs methyltricarboranylmethyl perchlorate as a replacement for some of the ammonium perchlorate and for all of the carboranyl plasticizer achieves both improved burning rate and improved mechanical properties. In addition to methyltricarboranylmethyl perchlorate, the propellant of this invention comprises a diisocyanate cross-linking agent, hydroxyl-terminated polybutadiene binder, an interfacial bonding agent and aluminum metal fuel.

3 Claims, No Drawings

ULTRAHIGH BURNING RATE PROPELLANTS CONTAINING AN ORGANIC PERCHLORATE OXIDIZER

DEDICATORY CLAUSE

The invention described herein may be manufactured, used, licensed by or for the Government for Governmental purposes without the payment to me of any royalties thereon.

CROSS-REFERENCE TO RELATED APPLICATION

The methyltricarboranylmethyl perchlorate used in the propellant of this invention is disclosed and claimed in my concurrently filed U.S. Patent application titled: "Organic Perchlorate Oxidizer for Ultrahigh Burning Rate Propellants."

BACKGROUND OF THE INVENTION

Carboranes and derivatives thereof have been and are being used as burning rate catalysts for solid propellant compositions. Normal-hexylcarborane and carboranylmethyl, -ethyl, or -propyl sulfide are typical carborane derivatives which are catalyst-plasticizer compounds that have been used for high burning rate propellants.

Inorganic and organic iron and iron-containing compounds have also been employed in propellants as burning rate catalysts. Ferrocene and ferrocene derivatives are typical of the organoiron compounds which have been used as burning rate catalysts.

Various theories and proposed mechanisms for the acceleration of propellant burning rates have evolved from experimentation in the field of catalysis. Apparently, the rate-controlling step for uncatalyzed propellant burning rates is determined mainly by the rate at which ammonium perchlorate undergoes decomposition. The burning rates of propellants increase as the particle size of the ammonium perchlorate is reduced. Smaller particle sizes facilitate the decomposition rate of ammonium perchlorate.

Very fine particle-sized (e.g. of only a few microns average mean-weight-diameter particle size) ammonium perchlorate in conjunction with catalysts (which have been incorporated in the propellant composition as liquid plasticizers) have been responsible for achieving ultrahigh burning rates for propellant compositions. The use of the liquid-type burning rate catalysts, however, has lead to other problems which include catalyst-plasticizer migration into the liner-insulation system.

The migration of liquid catalysts into the liner-insulation material can be eliminated by the use of a mixed intramolecular perchlorate salt: carboranyldiferrocenylmethyl perchlorate. The salt was disclosed and claimed in my U.S. Patent Application Ser. No. 120,682, filed Mar. 3, 1971. The activity of the compound is attributed to two different mechanisms for burning rate catalysis plus the oxidizer function which is derived from the perchlorate. Although the catalyst with both carboranyl and ferrocenyl funnctional groups has provided beneficial results, the carboranyl functional group alone has proven to be an excellent catalyst. The liquid carborane system does have, however, the undesirable feature of catalyst migration. Therefore, a solid carborane system would be highly desired since there would be no catalyst migration problem with a solid catalyst.

Desirable would be a propellant composition that employs a combination catalyst-oxidizer ingredient which can be used as a partial replacement for ammonium perchlorate without reducing the perchlorate ion content in the propellant composition. Advantageous would be the propellant composition employing a catalyst-oxidizer ingredient that is a solid ingredient and that has excellent compatibility with the other propellant ingredients. A catalyst-oxidizer ingredient which can be used as a replacement for the carborane catalyst-plasticizer in a propellant composition would be advantageous.

Therefore, an object of this invention is to provide a propellant composition which has improved burning rates and improved mechanical properties when the liquid catalyst-plasticizer is replaced with a catalyst-oxidizer ingredient.

Another object of this invention is to provide a propellant composition which employs a catalyst-oxidizer propellant ingredient that is stable with other propellant ingredients and that does not migrate into the liner-insulation system.

Still a further object of this invention is to provide a propellant composition which uses a lesser total amount of catalyst and ammonium perchlorate to thereby permit the use of a larger quantity of binder, and/or fuel, and/or oxidizer in the formulation to yield a propellant of high solids (metallic fuel, inorganic oxidizer) loading without adversely affecting the mechanical properties which is the situation which normally arises when the solids loading of a propellant is increased.

SUMMARY OF THE INVENTION

Methyltricarboranylmethyl perchlorate is employed as the combination catalyst-oxidizer of a propellant composition additionally comprised of hydroxyl-terminated polybutadiene, a diisocyanate crosslinking agent, an interfacial bonding agent, ammonium perchlorate oxidizer, and a metal fuel. The propellant composition of this invention has improved burning rates and improved mechanical properties. Since the methyltricarboranylmethyl perchlorate is a solid salt which contains three carboranyl functional groups and a perchlorate functional group per molecule, a gain in catalyst function and oxidizer function is achieved. The liquid carboranyl catalyst normally used can be replaced by the solid salt. Additional binder can be employed which permits the use of more oxidizer and metal fuel without a sacrifice of mechanical properties. The propellant is a high solids loading propellant with ultrahigh burning rates.

DESCRIPTION OF THE PREFERRED EMBODIMENT

The use of methyltricarboranylmethyl perchlorate in a composite propellant provides a means for simultaneously introducing a burning rate catalyst as part of a perchlorate-type oxidizer. This is illustrated in the following propellant compositions. Composition A depicts a propellant composition which has been especially developed as a high burning rate propellant as an alternate for the Safeguard System. Composition B depicts a comparable propellant which contains the methyltricarboranylmethyl perchlorate. The carboranyl content is maintained the same in both compositions of Table I.

TABLE I

A COMPARISON OF PROPELLANTS CONTAINING CARBORANYL BURNING RATE PROMOTERS

| | COMPOSITION A | COMPOSITION B |
|---|---|---|
| INGREDIENTS: (Wt %) | | |
| Hydroxyl-terminated Polybutadiene Prepolymer | 6.05 | 14.75 |
| Isophorone Diisocyanate | 0.50 | 1.50 |
| Bonding Agent (BA-114) | 0.35 | 0.35 |
| Normal Hexylcarborane | 13.10 | — |
| Methyltricarboranylmethyl perchlorate | — | 10.7 |
| Ammonium Perchlorate | 70.0 | 62.7 |
| Aluminum (H-30) | 10.0 | 10. |
| BALLISTIC PROPERTIES: | | |
| Isps (lbf-sec/lbm)(15° half angle) (1000/14.7 psia) | 255 | 255 |
| Ispsd (in 6-in motor) (lbf-sec/lbm) | 245 | 250 |
| Pressure Exponent (n) | 0.65 | 0.57 |
| Burning Rate (at 2000 psia)(ips) | 5.7 | 8–9 |
| MECHANICAL PROPERTIES: | | |
| Specific Gravity (gm/cc) | 1.63 | 1.64 |
| Stress/Strain (psi/%) | | |
| −40° F | 330/20 | Not Determined |
| +77° F | 150/30 | 225/40 |
| +140° F | 120/35 | Not Determined |
| Modulus (psi) | 600–700 | 1200–1300 |

The following conclusions are possible:

a. Because Composition B contains the same percentage of carboranyl moiety as Composition A, the burning rate should be nearly the same. Actually a considerable improvement in burning rate was observed.

b. Because a lesser amount of methyltricarboranylmethyl perchlorate is required to produce the same catalytic content, a larger amount of the hydroxyl-terminated polybutadiene prepolymer could be used. This would mean improved mechanical properties and processing characteristics.

c. If a lesser amount of hydroxyl-terminated polybutadiene prepolymer than that which is contained in Composition B were used, this would permit the use of a higher percentage of aluminum and ammonium perchlorate and result in higher performance with still better mechanical properties.

d. Since the presently-used n-hexylcarborane (see Composition A) is liquid, it undergoes migration into the liner-insulation system. This migration problem does not exist in Composition B insofar as the carboranyl compound is concerned because the burning rate promoter is a solid salt.

The synthesis of methyltricarboranylmethyl perchlorate can be accomplished by the following series of chemical steps, similar to the procedure described by A. N. Nesmeyanov, E. G. Perevalora, L. I. Leont'eva and Yu. A. Ustynyuk, Izvestia Akademii Nauk USSR, Scriya Khimcheskaya No. 3, pp 556-558, March 1966. It can be summarized by the following series of chemical equations:

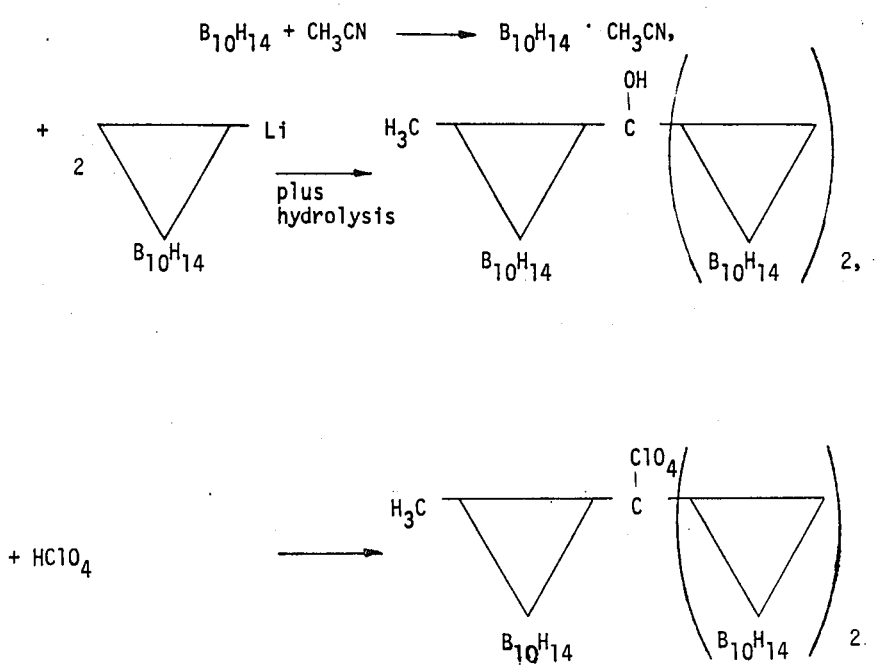

Synthesis of methyltricarboranylmethyl perchlorate involves the following: Decaborane is converted to carboranylcarbonitrile by reaction with acetonitrile. The carboranylcarbonitrile is reacted with carboranyllithium (which is prepared by the reaction of decaborane with acetylene, followed by lithiation) to form the methyldicarboranylketone which is reacted with an additional quantity of carboranyllithium to form the methyltricarboranylmethyl alcohol after hydrolysis. The alcohol is reacted with perchloric acid to form the methyltricarboranylmethyl perchlorate.

The bonding agent employed in the propellant compositions of Table I is added for the purpose of improving the mechanical properties of the cured propellant. The bonding agent functions as an interfacial bonding agent because it interacts with the ammonium perchlorate and the binder to form a chemical bond. When the propellant is then cured, a highly crosslinked network is produced among the AP, the binder and other propellant ingredients.

The interfacial bonding agents (BA-114) employed in the propellant formulations of this invention may be derived from di- or tri-functional aziridinylphosphine oxides or their derivatives reacted with polyfunctional carboxylic acids as specifically set forth in a commonly assigned Patent Application Ser. No. 851,137, filed July 30, 1969, now U.S. Pat. No. 3,762,972. The Nominal structure of the reaction product may be represented by the following general formula:

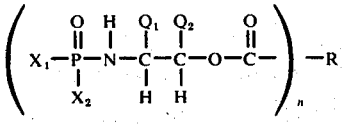

Where $X_1$ represents an aziridinyl group of the structure:

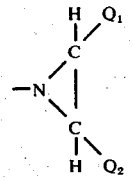

and $Q_1$ and $Q_2$ are either hydrogen or alkyl groups of one to four carbon atoms ($Q_1$ and $Q_2$ may be the same or different), $X_2$ may be the same as $X_1$ or may be an organic radical such as phenyl, benzyl, ethyl, etc., R is an alkyl that contains at least one active hydrogen atom or an organic entity or molecules that contain one or more hydroxyl groups, and *n* is 2, 3, or 4.

The reaction product described above, is produced by dissolving the reactants in a suitable inert organic solvent such as methanol, ethanol, methylene chloride, tetrahydrofuran, diethyl ether, or mixtures of these. It has been found to be preferable that methanol or ethanol comprise at least a part of the solvent. Reaction temperature is not critical, and may range from 70° F to 200° F for such time as is needed for essentially all carboxyl groups to be reacted. The solvent is then removed by any suitable means, such as, evaporation under reduced pressure at elevated temperatures. The residue is the reaction product, an interfacial bonding agent, which is usually straw-colored and quite viscous.

The perchlorate salt of this invention may be used in a propellant composition in amounts from about 5 to about 20 weight percent of the propellant composition. The salt is easily blended, utilizing standard mixing equipment and procedures. Other propellant ingredients include an additional oxidizer, preferably ammonium perchlorate, in amounts from about 60–72 weight percent, metal fuel (e.g. powdered aluminum, magnesium, titanium, zirconium, and boron) in amounts from about 5 to about 20 weight percent, a binder in amounts from about 6 to about 16 weight percent, a crosslinking agent in amounts from about 0.5 to about 1.0 weight percent, and additives for specific functions desired (e.g. ballistic modifiers, stabilizers, bonding agents etc.) in trace amounts from about 0.2 to 2.0 weight percent. Hydroxyl-terminated polybutadiene prepolymer serves as a binder after curing. The prepolymers are available with different functional groups and curatives or stabilizers. Appropriate crosslinking agents may be added. An appropriate crosslinking agent, isophorone diisocynate, is used with hydroxyl functional prepolymers to provide the necessary strength by crosslinking the binder for the propellant system. Additionally, the physical properties and stability of the propellant is enhanced by the use of from about 0.2 to about 0.4 weight percent of an interfacial bonding agent of the type described earlier herein.

The combination burning rate catalyst and oxidizer salt, methyltricarboranylmethyl, is compatible with a large number of propellant ingredients and can be advantageously utilized in propellant formulations which require higher burning rates than that which are presently derivable from the available burning rate catalysts of the organometallic type. Methyltricarboranylmethyl perchlorate is particularly suited for use with a propellant utilizing a high solids loading (e.g. high total percent of inorganic oxidizer, metal fuel, and a relatively small amount of a binder).

I claim:

1. A solid propellant composition comprised of methyltricarboranylmethyl perchlorate in amounts from about 5 to about 20 weight percent; an oxidizer in amounts from about 60 to about 72 weight percent; a metal fuel in amounts from about 5 to about 20 weight percent, said metal fuel selected from powdered aluminum, magnesium, titanium, zirconium, and boron; a binder in amounts from about 6 to about 16 weight percent; a crosslinking agent in amounts from about 0.5 to about 1.0 weight percent; and an interfacial bonding agent in amounts from about 0.2 to about 0.4 weight percent.

2. The propellant composition of claim 1 wherein said interfacial bonding agent has the structure represented by the following general formula:

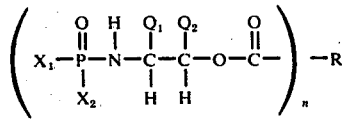

where $X_1$ represents an aziridinyl group of the structure:

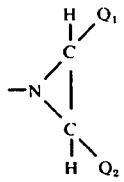

and $Q_1$ and $Q_2$ are either hydrogen or alkyl groups of one to four carbon atoms ($Q_1$ and $Q_2$ may be the same or different), $X_2$ may be the same as $X_1$ or may be an organic radical selected from phenyl, benzyl, ethyl, etc., R is an alkyl that contains at least one active hydrogen atom or an organic entity of molecules that contain one or more hydroxyl groups, and *n* is 2, 3, or 4.

3. The propellant composition of claim 2 comprised of said methyltricarboranylmethyl perchlorate in an amount of about 10.7 weight percent; said oxidizer which is ammonium perchlorate in an amount of about 62.7 weight percent; said selected metal fuel which is powdered aluminum in an amount of about 10 weight percent; said binder which is hydroxylterminated polybutadine prepolymer in an amount of about 14.75 weight percent; said crosslinking agent which is isophorone diisocyanate in an amount of about 1.50 weight percent; and said interfacial bonding agent in an amount of about 0.35 weight percent.

* * * * *